US007819056B2

(12) United States Patent
Iwamoto

(10) Patent No.: US 7,819,056 B2
(45) Date of Patent: Oct. 26, 2010

(54) METHOD OF AND SYSTEM FOR STENCIL PRINTING AND INK CONTAINER

(75) Inventor: Manabu Iwamoto, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 901 days.

(21) Appl. No.: 10/546,749

(22) PCT Filed: Dec. 19, 2003

(86) PCT No.: PCT/JP03/16318

§ 371 (c)(1),
(2), (4) Date: Aug. 24, 2005

(87) PCT Pub. No.: WO2004/076190

PCT Pub. Date: Sep. 10, 2004

(65) Prior Publication Data

US 2006/0288889 A1 Dec. 28, 2006

(30) Foreign Application Priority Data

Feb. 27, 2003 (JP) ..... 2003-050445

(51) Int. Cl.
*B41L 13/00* (2006.01)

(52) U.S. Cl. ..... 101/119; 101/116; 101/477; 347/7; 347/19; 347/86; 347/100

(58) Field of Classification Search ..... None
See application file for complete search history.

(56) References Cited

U.S. PATENT DOCUMENTS 5,699,731 A * 12/1997 Hara ..... 101/119
5,771,800 A * 6/1998 Inamine et al. ..... 101/119
5,937,750 A * 8/1999 Takeda ..... 101/116
6,196,670 B1 3/2001 Saruta (Continued)

FOREIGN PATENT DOCUMENTS

EP 1 004 447 5/2000

(Continued)

*Primary Examiner*—Matthew Luu
*Assistant Examiner*—John P Zimmermann
(74) *Attorney, Agent, or Firm*—Brian M. McGuire; Matthew K. Ryan; Frommer Lawrence & Haug LLP

(57) ABSTRACT

In a stencil printing method where a plurality of kinds of ink containers filled with ink of different colors are installed in a system body of a stencil printer and the ink in the ink container is supplied to a printing drum to carry out stencil printing, to easily set color information of the printing drum for determining whether the color information of the ink container conforms to the printing drum without necessity of operator's input. The color information stored in the storage means (9) of the ink container (10) installed in the system body (2) of the stencil printer is read out to a color information setting means (65), and at the same time, the color information setting means (65) confirms whether the color information has been already stored in the storage means (8) of the printing drum (31). When the color information has not been yet stored in the storage means (8) of the printing drum (31), the color information read out form the storage means (9) of the ink container (10) is stored in the storage means (8) of the printing drum (31).

8 Claims, 3 Drawing Sheets

U.S. PATENT DOCUMENTS

| | | | | |
|---|---|---|---|---|
| 6,295,924 | B1 * | 10/2001 | Nishihata et al. | 101/116 |
| 2002/0017210 | A1 | 2/2002 | Yanagi et al. | |
| 2003/0000397 | A1 * | 1/2003 | Inoue | 101/119 |
| 2004/0046821 | A1 * | 3/2004 | Kosugi | 347/19 |

FOREIGN PATENT DOCUMENTS

| | | |
|---|---|---|
| JP | 9-100 | 2/1997 |
| JP | 10-264357 | 10/1998 |
| JP | 2000-15916 | 1/2000 |
| JP | 2000-177106 | 6/2000 |
| JP | 2001-191630 | 7/2001 |
| JP | 2001-341290 | 12/2001 |
| JP | 2002-46332 | 2/2002 |
| JP | 2002-46334 | 2/2002 |
| JP | 2002-79652 | 3/2002 |
| JP | 2002-174993 | 6/2002 |

* cited by examiner

METHOD OF AND SYSTEM FOR STENCIL PRINTING AND INK CONTAINER

FIELD OF THE INVENTION

This invention relates to a method of and a system for stencil printing and an ink container where a plurality of kinds of ink containers filled with ink of different colors are installed in a system body of a stencil printer and the ink in the ink container is supplied to a printing drum to carry out stencil printing.

BACKGROUND OF THE INVENTION

There have been used a removable ink container in a stencil printer for the reason of easiness in handling or the like. The above-mentioned ink containers are generally installed in the system body to supply ink and then are removed when the ink is exhausted to be discarded or to be recycled. When a new expendable is mounted on the stencil printer thereafter, it becomes possible to continuously make print.

In the stencil printer using such an ink container, conventionally, any ink container has been able to be installed independently of the color of the ink in the ink container. Accordingly, when an ink container filled with ink different in color from the preceding ink is installed in the stencil printer, there has arisen a problem that the ink remaining in the printing drum mixes with the ink of a different color. In order to avoid such a problem, in Japanese Unexamined Utility Model Publication No. 9 (1997)-100, there has been proposed a stencil printer where a rib which differs in shape by the color of the ink in the ink container is provided on the ink container, and an alarm is given when the rib on the newly installed ink container differs in shape from that on the preceding ink container stored in the stencil printer. Further, in Japanese Unexamined Patent Publication No. 2000-15916, there has been proposed a stencil printer where a rib which differs in location by the color of the ink in the ink container is provided on the ink container, the location of the rib on the ink container is detected by a switch on the stencil printer to determine whether the ink container is compatible in color with the printing drum in which it is installed, and when the ink container is incompatible in color with the printing drum, supply of ink to the printing drum is inhibited. Further, in Japanese Unexamined Patent Publication No. 2000-15916, in order to determine whether such an ink container is usable, there is proposed a method where a memory is provided on the printing drum, locations of the ribs on the usable ink containers are stored in the memory, and the location of the rib detected by the switch on the stencil printer is compared with the stored locations of the ribs. Further, as a method of storing location information on the location of the rib on the ink container in the memory provided on the printing drum, in Japanese Unexamined Patent Publication No. 2001-191630, there is proposed a method where the operator directly inputs the location information in the stencil printer in which the printing drum is installed.

However, when a rib the shape or the location of which differs by the color of ink therein is provided on the ink container as in Japanese Unexamined Utility Model Publication No. 9 (1997)-100 or Japanese Unexamined Patent Publication No. 2000-15916, to make ribs the shape or the location of which corresponds to the colors of ink becomes difficult and leads to increase in the cost as the number of kinds of colors of the ink increases. To avoid this problem, in Japanese Unexamined Patent Publication No. 2001-18507, there is proposed a method where a memory is provided on the ink container, color information on the color of ink in the ink container is stored in the memory and the color information stored in the memory is read out by the stencil printer to compare with color information of the printing drum which has been set in advance to determine whether the ink container is usable. However, also in this method, it is necessary to set in advance the color information in the stencil printer. When the operator sets the color information in the stencil printer as in Japanese Unexamined Patent Publication No. 2001-191630, there arises a problem that input takes a lot of labor and becomes troublesome since the color information is a long character string depending on the code representing the color information.

In view of the foregoing observations and description, the primary object of the present invention is to provide a method of and a system for stencil printing and an ink container where, in methods of and systems for stencil printing and ink containers where a plurality of kinds of ink containers filled with ink of different colors are installed in a system body of a stencil printer and the ink in the ink container is supplied to a printing drum to carry out stencil printing, the color information can be easily set without necessity of the operator's direct input described above.

SUMMARY OF THE INVENTION

In accordance with the present invention, there is provided a stencil printing method comprising, in a method where an ink container which is filled with ink of one of a plurality of kinds of colors and provided with a storage means in which color information on the ink in the ink container is stored, and a printing drum provided with a storage means in which predetermined information is stored are installed in a body of a stencil printer, and the ink in the ink container is supplied to the printing drum to carry out stencil printing, the steps of, when an ink container and/or a printing drum is installed, reading out the color information stored in the storage means of the ink container and storing the color information in the storage means of the printing drum.

The "color information" may be any so long as it represents the kind of the color of the ink in the ink container. For example, the "color information" may be information representing the kind of the color of the ink by a code or by values of the coordinates of a LAB color specification system or a XYZ color specification system.

In the stencil printing method, it is possible to confirm whether the color information has been already stored in the storage means of the printing drum and then to subsequently store the color information read out from the storage means of the ink container in the storage means of the printing drum when it is confirmed that no color information has been yet stored in the storage means of the printing drum.

Further, it is possible to give an alarm when it is confirmed that color information has been already stored in the storage means of the printing drum and the stored color information differs from that read out from the ink container.

The "alarm" may be given in any manner so long as the operator is informed of that the color information stored in the storage means of the printing drum differs from that read out from the ink container. For example, the alarm may be given by displaying a message, lighting a lamp and/or sounding a warning sound.

Further, it is possible to store the color information read out from the storage means of the ink container in the storage means of the printing drum upon input of a signal which instructs to store the color information read out from the storage means of the ink container in the storage means of the printing drum when it is confirmed that color information has been already stored in the storage means of the printing drum and the stored color information differs from that read out from the ink container.

Further, it is possible to automatically start supplying ink to the printing drum after the color information stored in the storage means of the ink container is stored in the storage means of the printing drum.

Further, it is possible to make ink exhaustion, where the printing drum is rotated without supply of ink to the printing drum, when it is confirmed that color information has been already stored in the storage means of the printing drum and the stored color information differs from that read out from the ink container.

The "ink exhaustion" refers to an action of discharging ink remaining in the printing drum by rotating the printing drum without supply of ink to the printing drum, but any other actions may be combined with the action of rotating the printing drum without supply of ink to the printing drum.

Further, it is possible to store the color information read out from the storage means of the ink container in the storage means of the printing drum and to automatically start supplying ink to the printing drum thereafter after the ink exhaustion is finished.

Further, it is possible to store the color information read out from the storage means of the ink container in the storage means of the printing drum when it is detected that no ink exists in the printing drum and it is confirmed that no color information has been yet stored in the storage means of the printing drum.

Further, it is possible to give an abnormality alarm when it is detected that ink exists in the printing drum and it is confirmed that no color information has been yet stored in the storage means of the printing drum.

The "abnormality alarm" may be given in any manner so long as the operator is informed of that ink exists in the printing drum and it is confirmed that no color information has been yet stored in the storage means of the printing drum. For example, the abnormality alarm may be given by displaying a message, lighting a lamp and/or sounding a warning sound.

In accordance with the present invention, there is further provided a stencil printing system comprising, in a system where an ink container which is filled with ink of one of a plurality of kinds of colors and provided with a storage means in which color information on the ink in the ink container is stored, and a printing drum provided with a storage means in which predetermined information is stored are installed in a body of a stencil printer, and the ink in the ink container is supplied to the printing drum to carry out stencil printing, a color information setting means which, when an ink container and/or a printing drum is installed, reads out the color information stored in the storage means of the ink container and stores the color information in the storage means of the printing drum.

In the stencil printing system, it is possible to cause the color information setting means to confirm whether the color information has been already stored in the storage means of the printing drum and to store the color information read out from the storage means of the ink container in the storage means of the printing drum when it is confirmed by the color information setting means that no color information has been yet stored in the storage means of the printing drum.

Further, the stencil printing system may be provided with an alarm means which gives an alarm when it is confirmed by the color information setting means that color information has been already stored in the storage means of the printing drum and the stored color information differs from that read out from the ink container.

Further, the stencil printing system may be provided with a reset signal input means which inputs a signal instructing whether the color information read out from the storage means of the ink container is to be stored in the storage means of the printing drum when it is confirmed that color information has been already stored in the storage means of the printing drum and the stored color information differs from that read out from the ink container. In this case, the color information setting means stores the color information read out from the storage means of the ink container in the storage means of the printing drum upon input of a signal which instructs to store the color information read out from the storage means of the ink container in the storage means of the printing drum by the reset signal input means.

The "reset signal input means" may be any so long as it can input the above signal and, for instance, may be a button or a touch panel provided on the stencil printer.

Further, the stencil printing system may be provided with an ink supply control means which outputs an ink supply start signal to automatically start supplying ink to the printing drum after the color information stored in the storage means of the ink container is stored in the storage means of the printing drum by the color information setting means.

Further, the stencil printing system may be provided with an ink exhaustion control means which outputs an ink exhaustion control signal to make ink exhaustion, where the printing drum is rotated without supply of ink to the printing drum, when it is confirmed that color information has been already stored in the storage means of the printing drum and the stored color information differs from that read out from the ink container.

Further, it is possible to make the color information setting means store the color information read out from the storage means of the ink container in the storage means of the printing drum after the ink exhaustion is finished and the stencil printing system may be provided with an ink supply control system which automatically starts supplying ink to the printing drum after the color information read out from the storage means of the ink container is stored in the storage means of the printing drum by the color information setting means.

Further, the stencil printing system may be provided with an ink detecting means which detects whether there is ink in the printing drum. In this case, the color information setting means stores the color information read out from the storage means of the ink container in the storage means of the printing drum when it is detected that no ink exists in the printing drum by the ink detecting means and it is confirmed that no color information has been yet stored in the storage means of the printing drum by the color information setting means.

Further, the stencil printing system may be provided with an ink detecting means which detects whether there is ink in the printing drum. In this case, the stencil printing system may be provided with an abnormality alarm means which gives an abnormality alarm when it is detected that ink exists in the printing drum by the ink detecting mans and it is confirmed that no color information has been yet stored in the storage means of the printing drum by the color information setting means.

In accordance with the present invention, there is further provided an ink container which is used for carrying out the above stencil printing method and comprises storage means which stores color information on ink in the ink container.

In the method of and the system for stencil printing and the ink container of the present invention, since the color information stored in the storage means of the ink container is read out and the color information is stored in the storage means of the printing drum, the color information can be easily set in the storage means of the printing drum without necessity of the operator's direct input. Further, even if the operator does not recognize the color information on the ink container, the color information can be set. For example, by inhibiting the stencil printing when an ink container whose color information differs from the color information thus set in the storage means of the printing drum is installed, mixing of ink of different colors in the printing drum can be avoided. Further, more number of the kinds of color information can be set as compared with the case where the color information is set, for instance, by the shape of the rib provided on the ink container, a slight difference in color can be known, and it is possible to avoid the case where the operator installs and uses a wrong ink container which is similar to the correct ink container in color by accident.

Further, in the method of and the system for stencil printing and the ink container, when whether the color information has been already stored in the storage means of the printing drum is confirmed and then the color information read out from the storage means of the ink container in the storage means of the printing drum is subsequently stored when it is confirmed that no color information has been yet stored in the storage means of the printing drum, the color information which has been already set in the storage means of the printing drum can be avoided from being overwritten.

Further, when an alarm is given in the case where it is confirmed that color information has been already stored in the storage means of the printing drum and the stored color information differs from that read out from the ink container, the operator can be clearly informed of the fact that an ink container whose color information differs from the color information set in the storage means of the printing drum is installed.

Further, when the color information read out from the storage means of the ink container is stored in the storage means of the printing drum upon input of a signal which instructs to store the color information read out from the storage means of the ink container in the storage means of the printing drum when it is confirmed that color information has been already stored in the storage means of the printing drum and the stored color information differs from that read out from the ink container, the color information which has been already set in the storage means of the printing drum can be avoided from being overwritten by accident and at the same time, the color information set in the storage means of the printing drum can be changed at will of the operator.

Further, when supplying ink to the printing drum is automatically started after the color information stored in the storage means of the ink container is stored in the storage means of the printing drum, the labor of the operator to input a signal which instructs to start supplying ink to the printing drum can be saved.

Further, when ink exhaustion, where the printing drum is rotated without supply of ink to the printing drum, is made un the case where it is confirmed that color information has been already stored in the storage means of the printing drum and the stored color information differs from that read out from the ink container, ink remaining in the printing drum can be avoided from being mixed with ink supplied from the ink container when the color information stored in the storage means of the printing drum is changed.

Further, when the color information read out from the storage means of the ink container is stored in the storage means of the printing drum and supplying ink to the printing drum is automatically started thereafter after the ink exhaustion is finished, the labor of the operator to input a signal which instructs to start supplying ink to the printing drum can be saved.

Further, when the color information read out from the storage means of the ink container is stored in the storage means of the printing drum in the case where it is detected that no ink exists in the printing drum and it is confirmed that no color information has been yet stored in the storage means of the printing drum, it can be avoided to set color information in the storage means of a printing drum by mistaking the printing drum for a unused one even if, for instance, the storage of color information in the storage means of the printing drum is not correctly carried out.

Further, when an abnormality alarm is given in the case where it is detected that ink exists in the printing drum and it is confirmed that no color information has been yet stored in the storage means of the printing drum, the operator can recognize that the storage of color information in the storage means of the printing drum has not been correctly carried out, the color information has not been correctly read out from the storage means of the printing drum, or the ink sensor does not correctly operate.

PREFERRED EMBODIMENTS OF THE INVENTION

Figure 1:
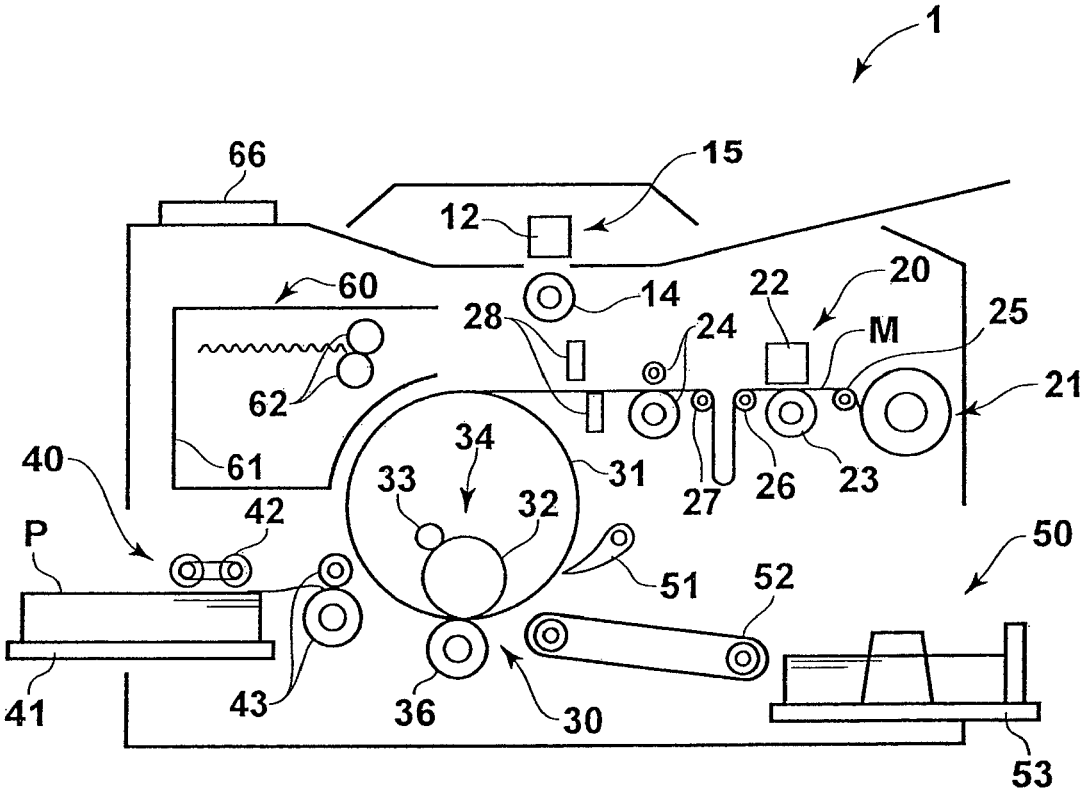
FIG. 1 is a view showing in brief a stencil printer for carrying out the printing method in accordance with an embodiment of the present invention.

A stencil printer for carrying out a stencil printing method in accordance with the present invention and an ink container which is used for carrying out a stencil printing method in accordance with the present invention will be described, hereinbelow, with reference to the drawings. FIG. 1 is a view showing in brief the stencil printer.

As shown in FIG. 1, the stencil printer 1 comprises an image reading portion 15 which reads out an image on an original, a stencil making portion 20 which makes a stencil from stencil material M on the basis of the image information read by the image reading portion 15, a printing portion 30 which prints on a printing paper by the use of the stencil made by the stencil making portion 20, a paper supply portion 40 which supplies the printing paper to the printing portion 30, a paper discharge portion 50 which discharges the printed printing paper from the printing portion 30, and a stencil discharge portion 60 which discharges the stencil after use.

The image read-out portion 15 is an image scanner and comprises an image line sensor 12 which reads out an image on an original conveyed in a sub-scanning direction, and original feed rollers 14.

The stencil making portion 20 comprises a stencil material roll portion 21, a stencil making unit 22 having a thermal head where a plurality of heater elements are arranged in a row, stencil material feed rollers 23 and 24, stencil material guide rollers 25, 26 and 27, and a stencil cutter 28.

The printing portion 30 comprises a cylindrical ink-transmittable printing drum 31 which is formed of a porous metal plate or a mesh structure, an ink supply system 34 having a squeegee roller 32 and a doctor roller 33 and an ink supply pump 35 (FIG. 2) which are disposed inside the printing drum 31, and a press roller 36. The stencil is wound around outer periphery of the printing drum 31.

Figure 2:
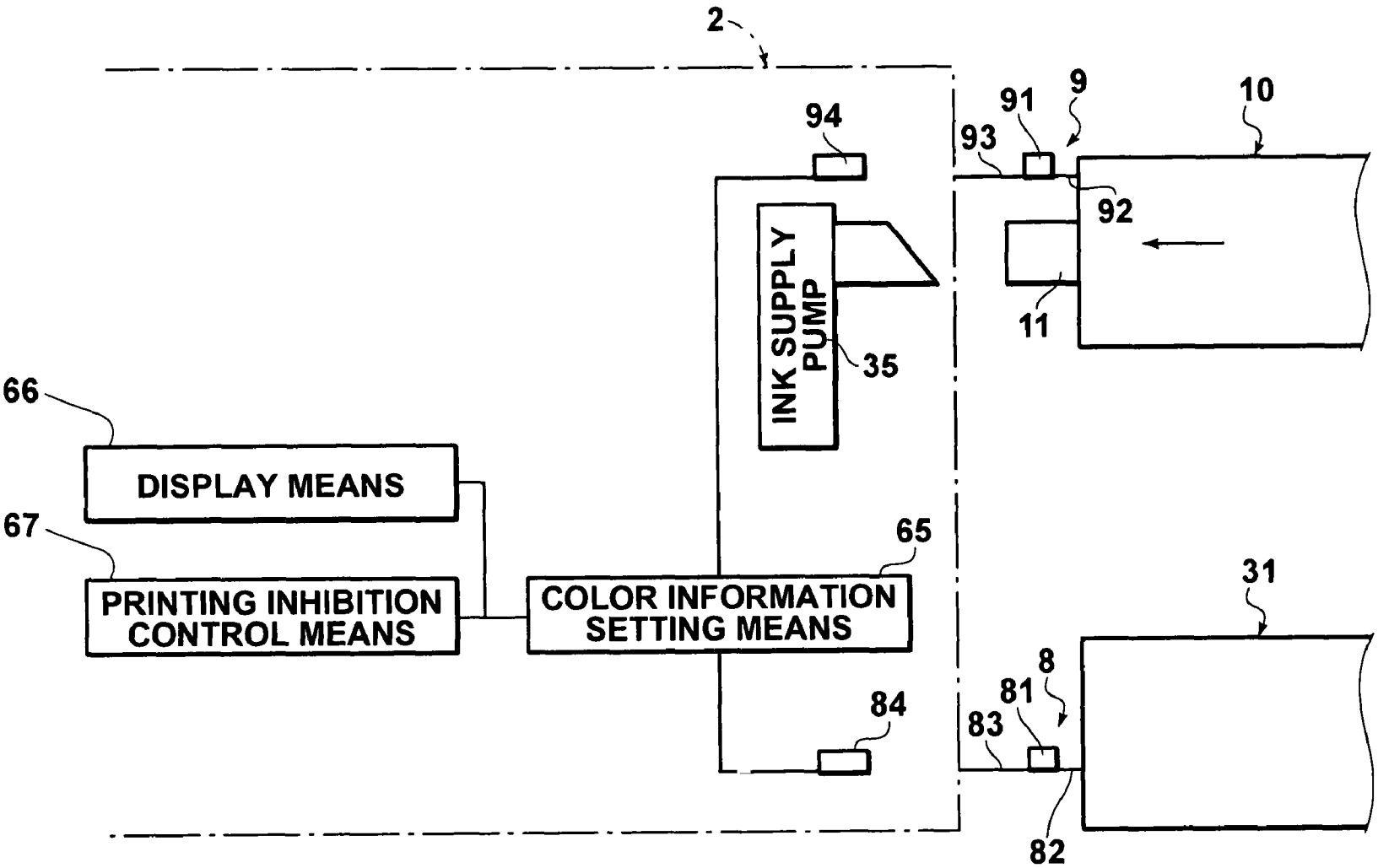
FIG. 2 is a view showing in brief a part of the stencil printer shown in FIG. 1.

The printing drum 31 is provided, as shown in FIG. 2, with a storage means 8 which stores predetermined information. The storage means 8 comprises a memory IC 81 forming a non-volatile memory (e.g., an EEPROM) which can hold data for a predetermined time without power supply, and a contact 83 is provided on the tip of a board 82 on which the memory IC 81 is mounted. The storage means 8 is disposed in a support member mounted for rotation with respect to the printing drum 31.

The ink container 10 in which ink to be used in the printing portion 30 is provided at its leading end with an opening 11 through which the ink is discharged as shown in FIG. 2. The opening 11 is connected to an ink supply pump 35 disposed inside the printing drum 31. The ink container 10 is provided at its leading end portion with a storage means 9 which stores predetermined information. The storage means 9 comprises a memory IC 91 forming a non-volatile memory (e.g., an EEPROM) which can hold data for a predetermined time without power supply, and a contact 93 is provided on the tip of a board 92 on which the memory IC 91 is mounted. Color information representing the kind of color of the ink filled in the ink container is stored in the memory IC 91 of the storage means 9. The color information to be stored in the memory IC 91 may be, for instance, values of the coordinates of a LAB color specification system or a XYZ color specification system.

Figure 3:
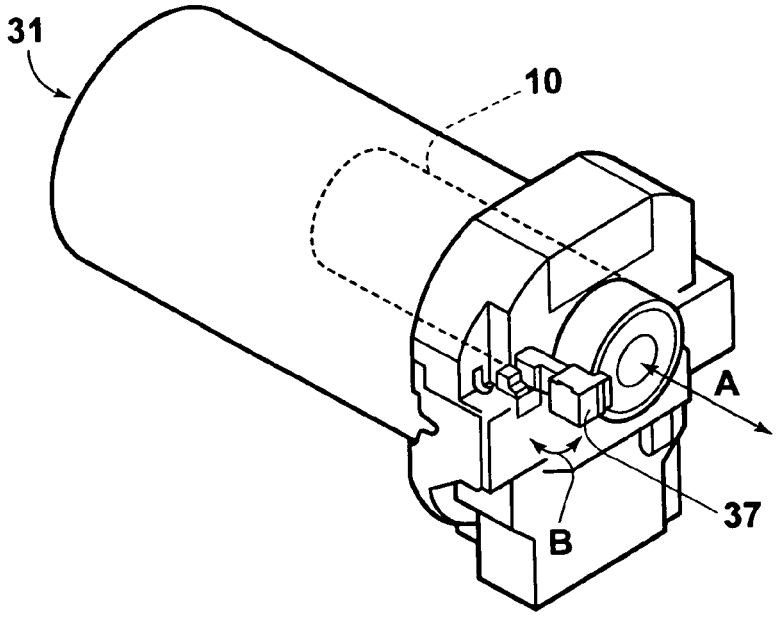
FIG. 3 is a view showing the printing drum and the ink container of the stencil printer shown in FIG. 1.

As shown in FIG. 3, the ink container 10 and the printing drum 31 are schematically shown for the purpose of description, and the ink container 10 is moved back and forth in the direction of arrow A at the center of one end of the printing drum 31 and removably installed in the printing drum 31 by moving the fixing member 37 in the direction of arrow B. Further, the printing drum 31 is also removable.

Further, as shown in FIG. 2, the stencil printer body 2 is provided with a color information setting means 65 which reads out the color information stored in the storage means 9 of the ink container 10 and stores the same in the storage means 8 of the printing drum 31. A connector 94 which is to be electrically connected to the contact 93 of the storage means 9 of the ink container 10 and a connector 84 which is to be electrically connected to the contact 83 of the storage means 8 of the printing drum 31 are connected to the color information setting means 65.

The paper supply portion 40 comprises a paper supply table 41 on which printing papers P are stacked, a pair of pick-up rollers 42 which take out the printing papers P one by one from the paper supply table 41, and a pair of timing rollers 43 which sends a printing paper P between the printing drum 31 and the press roller 36.

The paper discharge portion 50 comprises a separator 51 which peels off printing paper P from the printing drum 31, a paper discharge belt portion 52, and a paper discharge table 53 on which the printed printing papers P are stacked.

The stencil discharge portion 60 comprises a stencil discharge box 61 which is disposed on one side of the printing portion 30 and in which the stencil peeled off the printing drum 31 is placed, and a pair of stencil discharge rollers 62 which peel the stencil off the printing drum 31 after use and convey the stencil peeled off the printing drum 31 into the stencil discharge box 61.

As shown in FIG. 2, the stencil printer body 2 further comprises a display means 66 which displays a message, when the color information read out from the storage means 9 of the ink container 10 differs from that stored in the storage means 8 of the printing drum 31, representing the fact, and a printing inhibition control means 67 which inhibits stencil printing in the above-mentioned case. The display means 66 is a touch panel which is formed by a liquid crystal panel and can be used to input a predetermined signal.

Operation of the stencil printer of this embodiment will be described, hereinbelow.

An unused printing drum 31 is installed in the printing portion 30 of the stencil printer body 2 and the contact 83 of the storage means 8 of the printing drum 31 is connected to the connector 84. Thereafter, an ink container 10 is installed in the ink supply pump 35 of the ink supply system 34, and the contact 93 of the storage means 9 of the ink container 10 is connected to the connector 94.

The color information setting means 65 first reads out the color information from the storage means 9 of the ink container 10 and then confirms whether the color information has been already stored in the storage means 8 of the printing drum 31 and outputs the color information read out from the storage means 9 of the ink container 10 to the storage means 8 of the printing drum 31 by way of the connector 84 and the contact 83 to store the same when it is confirmed that no color information has been yet stored in the storage means 8 of the printing drum 31. By causing the storage means 8 of the printing drum 31 to store the color information of the ink container 10, that the printing drum 31 is to be used with ink of a color corresponding to the color information can be set in the printing drum 31.

Whereas a stencil material roll is installed on the master holder and the stencil material M is unrolled from the stencil material roll in a length corresponding to one stencil which has been set in advance. The stencil material M unrolled from the stencil material roll is thermally perforated in the stencil making portion 20 by selectively energizing the heater elements of the thermal head 22 and is cut by the stencil cutter 28 into a stencil. Then the stencil is wound around the printing drum 31.

After the color information is stored in the storage means 8 of the printing drum 31 in the manner described above, ink the color of which corresponds to the color information stored in the storage means 9 of the ink container 10 and the storage means 8 of the printing drum 31 is automatically supplied inside the printing drum 31 by the ink supply system 34.

As the printing drum 31 is rotated in the counterclockwise direction as seen in FIG. 1, a printing paper P is moved left to right as seen in FIG. 1 by timing rollers 43 to be supplied between the printing drum 31 and the press roller 36 at a predetermined timing in synchronization with the rotation of the printing drum 31. The printing paper P is subsequently pressed by the press roller 36 against the stencil M on the outer peripheral surface of the printing drum 31, whereby the printing paper P is printed with the ink in the color described above.

For example, when the ink in the ink container 10 is exhausted and a new ink container 10 is installed after the stencil printing is carried out as described above, the color information setting means 65 again reads out the color information from the storage means 9 of the ink container 10 and then confirms whether the color information has been already stored in the storage means 8 of the printing drum 31. When the color information has been already stored in the storage means 8 of the printing drum 31, the color information setting means 65 reads out the color information from the storage means 8 of the printing drum 31 and confirms whether it conforms to the color information reads out from the storage means 9 of the new ink container 10. When the former conforms to the latter, the stencil printing is continued in the same manner as described above. However, when the former does not conform to the latter, the color information setting means 65 causes the display means 66 to display a message representing the fact. The display means 66 displays together with the message a resetting button which permits selection whether the color information stored in the storage means 8 of the printing drum 31 is to be overwritten by the color information stored in the storage means 9 of the newly installed ink container 10. Further, the color information setting means 65 outputs to the printing inhibition control means 67 that the pieces of color information does not conform to each other and the printing inhibition control means 67 controls the system so that the stencil printing cannot be continued. When the operator selects the resetting button to overwrite the color information, the color information setting means 65 outputs the color information read out from the storage means 9 of the ink container 10 to the storage means 8 of the printing drum 31 to overwrite the color information and at the same time, outputs to the printing inhibition control means 67 a signal which instructs release of the printing inhibition so that the printing inhibition by the printing inhibition control means 67 is released and the stencil printing is continued in the same manner as described above. Whereas when the operator selects the resetting button not to overwrite the color information, the color information setting means 65 does not output the color information read out from the storage means 9 of the ink container 10 and the printing inhibition is held until an ink container 10 whose color corresponds to the color information stored in the storage means 8 of the printing drum 31 is installed or the operator selects and pushes the resetting button to overwrite the color information.

Though, in the embodiment described above, when the color information stored in storage means 9 of the ink container 10 differs from that stored in storage means 8 of the printing drum 31 and the operator selects the resetting button to overwrite the color information, the color information is overwritten and the stencil printing is continued, ink exhaustion may be carried out before resumption of the stencil printing. The "ink exhaustion" is an action to rotate the printing drum 31 without operation of the ink supply pump 35 so that no ink remains in the printing drum 31.

In the case where the ink exhaustion is carried out, for instance, the color information is stored in the storage means 8 of the printing drum 31 after the ink exhaustion and then the ink supply pump 35 is automatically operated to start supply of ink. The end of the ink exhaustion may be instructed by a signal input by a predetermined input means by the operator or the ink exhaustion may be carried out for a predetermined time which has been set in advance.

Figure 4:
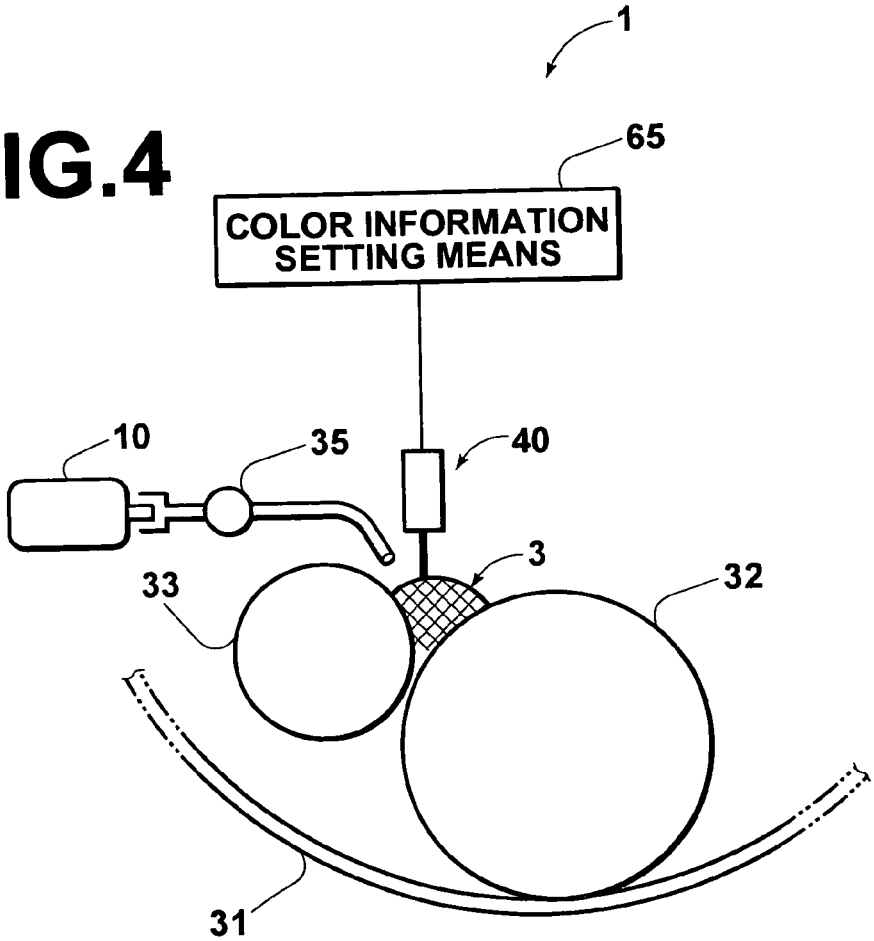
FIG. 4 is a view showing in brief a part of the stencil printer in accordance with another embodiment of the present invention.

In this embodiment, it is possible to temporarily store ink, for instance, in an ink fountain 3 between the squeegee roller 32 and the doctor roller 33 as shown in FIG. 4 and detect the ink stored in the ink fountain 3 by an ink sensor 40 so that the color information setting means 65 outputs the color information read out from the storage means 9 of the ink container 10 to the storage means 8 of the printing drum 31 when it is confirmed that no color information has been yet stored in the storage means 8 of the printing drum 31 by the color information setting means 65 and it is detected that no ink exists in the printing drum 31 by the ink sensor 40. By this, since the color information is stored in the printing drum 31 after it is confirmed whether ink exists in the printing drum 31, it can be avoided to set color information in the storage means 8 of a printing drum 31 by mistaking the printing drum 31 for a unused one or to supply ink of a different color to the printing drum 31 even in the case where, for instance, the data of the color information stored in the storage means 8 of the printing drum 31 is destroyed or the color information has not been correctly stored in the storage means 8 of the printing drum 31 by accident.

Further, it is possible to cause, when that ink exists in the printing drum 31 is detected by the ink sensor 40 and that the color information stored in the storage means 8 of the printing drum 31 is not confirmed by the color information setting means 65, the display means 66 to display a message representing the fact. By causing the display means 66 to display the message, the operator can recognize an abnormality that the color information has not been correctly read out from the storage means 8 of the printing drum 31, or the ink sensor 40 does not correctly operate.

The invention claimed is:

1. A stencil printing system comprising, in a system where an ink container which is filled with ink of one of a plurality of kinds of colors and provided with a storage means having a memory in which color information representing the kind of the color of the ink in the ink container is stored, and a printing drum provided with a storage means in which predetermined information is stored are installed in a body of a stencil printer, and the ink in the ink container is supplied to the printing drum to carry out stencil printing, a color information setting means which, when an ink container and/or a printing drum is installed, reads out the color information stored in the storage means of the ink container and stores the color information in the storage means of the printing drum, wherein the color information setting means confirms whether the color information has been already stored in the storage means of the printing drum, and stores the color information read out of the storage means of the ink container in the storage means of the printing drum when it is confirmed by the color information setting means that no color information has been yet stored in the storage means of the printing drum.

2. A stencil printing system as defined in claim 1 further comprising an alarm means which gives an alarm when it is confirmed by the color information setting means that color information has been already stored in the storage means of the printing drum and the stored color information differs from that read out from the ink container.

3. A stencil printing system as defined in claim 1 further comprising a reset signal input means which inputs a signal instructing whether the color information read out from the storage means of the ink container is to be stored in the storage means of the printing drum when it is confirmed that color information has been already stored in the storage means of the printing drum and the stored color information differs from that read out from the ink container, wherein the color information setting means stores the color information read out from the storage means of the ink container in the storage means of the printing drum upon input of the signal by the reset signal input means.

4. A stencil printing system as defined in claim 1 further comprising an ink supply control means which outputs an ink supply start signal to automatically start supplying ink to the printing drum after the color information stored in the storage means of the ink container is stored in the storage means of the printing drum by the color information setting means.

5. A stencil printing system as defined in claim 1 further comprising an ink exhaustion control means which outputs an ink exhaustion control signal to make ink exhaustion, where the printing drum is rotated without supply of ink to the printing drum, when it is confirmed that color information has been already stored in the storage means of the printing drum and the stored color information differs from that read out from the ink container.

6. A stencil printing system as defined in claim 5 in which the color information setting means stores the color information read out from the storage means of the ink container in the storage means of the printing drum after the ink exhaustion is finished and the stencil printing system further comprising an ink supply control system which automatically starts supplying ink to the printing drum after the color information read out from the storage means of the ink container is stored in the storage means of the printing drum by the color information setting means.

7. A stencil printing system as defined in claim 1 further comprising an ink detecting means which detects whether there is ink in the printing drum, wherein the color information setting means stores the color information read out from the storage means of the ink container in the storage means of the printing drum when it is detected that no ink exists in the printing drum by the ink detecting means and it is confirmed that no color information has been yet stored in the storage means of the printing drum by the color information setting means.

8. A stencil printing system as defined in claim 1 further comprising an ink detecting means which detects whether there is ink in the printing drum and an abnormality alarm means which gives an abnormality alarm when it is detected that ink exists in the printing drum by the ink detecting means and it is confirmed that no color information has been yet stored in the storage means of the printing drum by the color information setting means.

* * * * *